United States Patent [19]

Pasbrig

[11] 4,350,335

[45] Sep. 21, 1982

[54] APPLIANCE FOR USE IN FINGER EXERCISES

[75] Inventor: Max Pasbrig, Orselina, Switzerland

[73] Assignee: Lacrex Brevetti S.A., Orselina, Switzerland

[21] Appl. No.: 206,014

[22] Filed: Nov. 12, 1980

[51] Int. Cl.[3] ..... A63B 11/08

[52] U.S. Cl. ..... 272/67; 272/141

[58] Field of Search ..... 272/67, 141, 137, 142; 84/465, 467, 468, 469; 124/68, 37

[56] References Cited

U.S. PATENT DOCUMENTS

| | | | |
|---|---|---|---|
| 2,440,577 | 4/1948 | Denby | 272/142 X |
| 3,227,446 | 1/1966 | Minasola | 272/67 |
| 3,738,651 | 6/1973 | Norman | 272/67 |
| 3,871,646 | 3/1975 | Slack | 272/67 |

*Primary Examiner*—Richard J. Johnson

*Attorney, Agent, or Firm*—Fleit & Jacobson

[57] ABSTRACT

At least one pair of axially aligned sliders are axially slidably mounted in a frame and have confronting faces and are urged toward each other by spring means. Each of said sliders has an exposed side. Each of said confronting faces is formed with a depression which is open on said exposed side and adapted to receive a fingertip.

10 Claims, 2 Drawing Figures

APPLIANCE FOR USE IN FINGER EXERCISES

This invention relates to an appliance for use in finger exercises, particularly for active physiotherapy.

The ease with which the fingers can be moved and the force which can be exerted by the flexor and extensor muscles of the fingers can be substantially improved by kinetotherapy. Such kinetotherapeutic exercises can be performed without an appliance, simply in that the fingers are flexed and stretched, but in that case there will be no resistance opposing the movement so that optimum results cannot be produced. A known handle-like appliance comprises handle shells, which can be forced toward each other against spring pressure. Only the flexor muscles can be strained in that way. That appliance has also the disadvantage that it cannot be actuated unless the hand has been almost completely closed. For this reason the appliance cannot be used with useful results unless the mobility of the hand has been substantially preserved. The appliance is of little use where the fingers are very slack or very stiff, particularly because the implement does not permit an actuation of only individual fingers or a differential straining of individual fingers.

For this reason it is an object of the invention to provide an appliance which permits flexor and extensor muscle movements even of individual fingers against an opposing force.

To accomplish this object the invention provides an implement comprising at least one pair of sliders, which are adapted to be displaced in mutually opposite directions along a straight line against spring force and have mutually confronting end faces which are formed with depressions which are open to an exposed side of the slider and adapted to receive respective fingertips.

There is suitably one pair of sliders for each finger and the sliders of each of said pairs are desirably slidably mounted on a common guide rod, which may be surrounded by compression springs biasing the sliders.

The spring bias can be adjusted to suit individual requirements if the compression springs are adjustable. This can conveniently be accomplished by means of a screw mechanism. Each slider is suitably biased by two springs, which consist of a weaker spring for the initial exercises and a stronger spring for more exacting exercises.

In the use of the appliance according to the invention, each finger can perform flexing, stretching and pushing movments which are opposed by an adjustable pressure. In this way the ease of movement of the fingers and particularly the strength of the muscles can be greatly increased. The appliance can well be used in physiotherapy as well as for the training of sportsmen, musicians etc.

Figure 1:
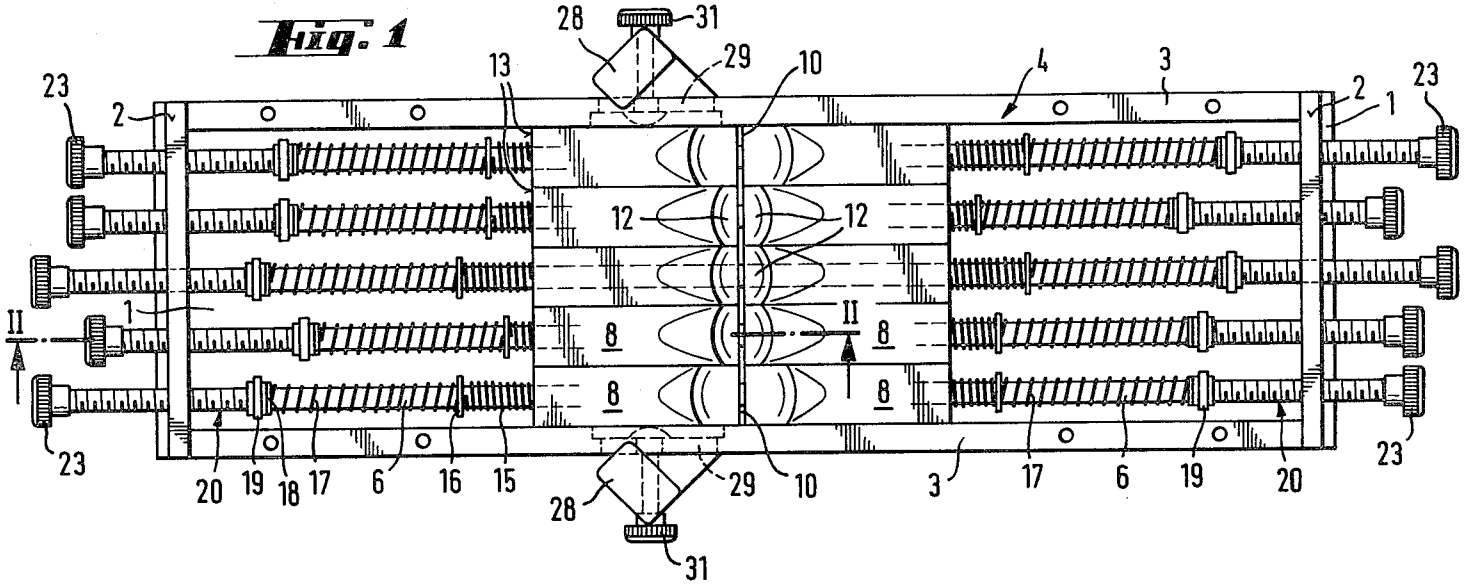
Figure 2:
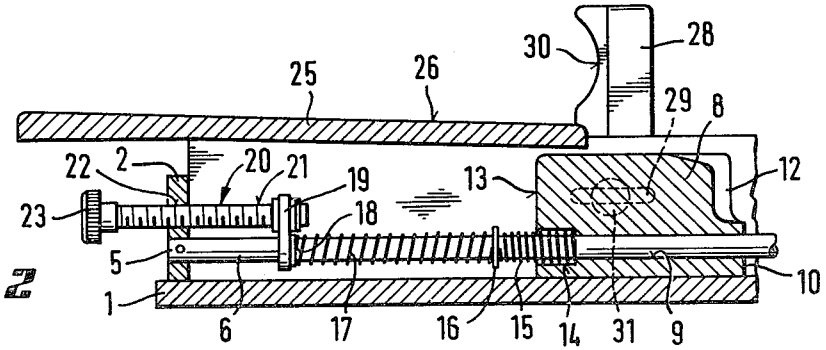

Further features and details of the invention will become apparent from the following description of an illustrative embodiment which is diagrammatically shown on the drawing, in which FIG. 1 is a top plan view showing the appliance with the cover plates removed and FIG. 2 is a vertical sectional view showing one half of the appliance.

The mechanism of the appliance is accommodated in a housing 4, which comprises a baseplate 1, two end walls 2 and two side walls 3. Guide rods 6 have end portions 5, which are fixed against axial displacement in the end walls 2, e.g., by screwed joints, split pins or the like means (not shown). The guide rods 6 are parallel to each other. A plurality of sliders 8 are provided, each of which has a bore 9, which is a sliding fit on one of the rods 6 so that the slider 8 is easily movable along the rod along a straight line. Two sliders 8 are slidably mounted on each of the rods 6 in the central portion of the appliance and have confronting end faces 10, which engage each other in an initial position. These end faces 10 are formed in their upper portions with depressions 12, which are so deep and set back to such an extent that a fingertip can easily be inserted between said end faces. Each bore 9 has near the rear end face 13 of the slider 8 an enlarged portion 14, which contains a relatively weak compression spring 15, which is succeeded by a relatively strong compression spring 17. A washer 16 interposed between the springs 15 and 16 is slidably fitted on the guide rod 6. An adjusting screw 20 is connected by a link 18 to the rear end of the compression spring 17. The adjusting screw 20 is rotatably mounted in the link 19 and has external screw threads 21, which are in threaded engagement with internal screw threads 22 formed in the end wall 2. The actuation of this screw is facilitated by a handle 23 provided at the outer end of the screw so that the spring pressure can easily be adjusted. In the embodiment shown by way of example, each slider has associated with it a separate set of springs and an adjusting screw. Alternatively, a plurality or all of the sliders of a group may have associated therewith a common adjusting mechanism. A bearing surface for the hand to be treated is provided by two cover plates 25, which are supported on respective side walls on opposite sides of the sliders and cover the mechanism of the appliance except for the sliders. The surface 26 of said cover plate suitably slopes slightly toward the sliders. To provide a stop for the hand during the exercies, thumb abutments 28 protruding above the cover plate are mounted on the side walls 3 and are suitably mounted in a slot 29, which permits an adjustment of the optimum distance from each thumb abutment to the depressions of the sliders. Each abutment is formed with a concave recess 30 for receiving the thumb or its root. In the embodiment shown by way of example, all sliders are identical. Five pairs of sliders are suitably provided, i.e., one pair of sliders for each finger of a hand. Alternatively, one of said sliders may be higher and/or be provided with somewhat deeper depressions, as is illustrated by the depressions in the outer sliders in FIG. 1.

For use, the appliance is placed on a table top or a similar support and the palm of one hand is placed on one of the cover plates so that the thumb bears on the adjacent thumb abutment. The fingertips are then inserted into the depressions 12. Now the flexing and stretching movements can be performed. As the fingertips and the other finger joints are bent or flexed, the group of sliders which have been engaged are pushed back. When stretching exercises are to be performed too, the fingers are stretched to depress the opposite sliders. This movement can be performed in alternation to the flexing movements or in accordance with a predetermined different program. The sliders are displaced against spring pressure, which can be adjusted for each slider. If an excessively large resistance to the movement is not desired, the adjusting screws 20 are screwed back to such an extent that the weaker springs 15 are effective and take up substantially the entire movement of the sliders. To provide for a strong backpressure, the adjusting screws 20 can be screwed in to such an extent that the weaker spring is compressed as far as possible so that it is no longer compliant and only the strong spring 17, which is under a corresponding initial stress, is effective.

The invention is not restricted to the embodiment shown by way of example. Instead of five pairs of sliders, sliders in any desired number of pairs may be accommodated in a housing, for instance, one pair for treating one finger or ten pairs for simultaneous exercises with both hands. The sliders may be guided by rails or dovetail grooves provided on or in the baseplate of the housing rather than by rods.

Finally, the housing and the continuous guide rods may be split so that one half of the housing can be used alone, e.g., when only flexing exercises are to be performed.

What is claimed is:

1. An appliance for use in finger exercises, said appliance comprising:

a frame, a common guide rod fixed in said frame, at least one pair of axially aligned sliders, which are exposed to one side and axially slidably mounted on said common guide rod in said frame, each of said sliders having confronting faces, spring means urging said sliders of said pair toward each other, said spring means for each of said sliders including a relatively weak spring having an inner end adjacent to the associated slider and an outer end, and a relatively strong spring having an inner end bearing on said outer end of said weak spring and an outer end adjacent to one of said end walls, two adjusting screws screwably mounted in respective ones of said end walls and having inner ends operatively connected to said outer ends of respective ones of said strong springs, and each of said confronting faces being formed with a depression which is open on said exposed side of the slider and adapted to receive a fingertip.

2. An appliance as set forth in claim 1, wherein said spring means comprise for each of said sliders two springs having different spring constants and arranged one beside the other.

3. An appliance as set forth in claim 1, comprising means for prestressing said spring means.

4. An appliance as set forth in claim 1, wherein each of said adjusting screws is parallel to and laterally spaced from the guide rod on which the associated slider is slidably mounted and the inner end of each of said adjusting screws is connected by a link to the outer end of the associated stronger spring.

5. An appliance as set forth in claim 1, wherein said frame comprises a housing having opposite side walls extending in the longitudinal direction of said sliders, at least three pairs of said sliders are accommodated in said housing and comprise two pairs of outer sliders and at least one pair of intermediate sliders, each of said outer slider is in sliding contact with one of said side walls and an adjacent intermediate slider, and each of said intermediate sliders is in sliding contact with adjacent sliders.

6. An appliance as set forth in claim 1, wherein said frame comprises a housing having a cover plate for supporting the hand to which the fingers belong with which an exercise is to be performed.

7. An appliance as set forth in claim 1, wherein said frame comprises first and second housings, a plurality of pairs of sliders are provided and are axially parallel and transversely aligned, each of said pairs consists of a first slider accommodated in said first housing and a second slider accommodated in said second housing, each of said housings has an inner end wall adjacent to said confronting faces of said sliders accommodated in said housing, and the sliders of each of said pairs are slidably mounted on a guide rod, which is mounted in said end walls of said first and second housings.

8. An appliance as set forth in claim 7, wherein said first and second housings are detachably assembled to form a dual housing.

9. An appliance to be held in the hand for use in finger exercises, said appliance comprising:

a frame, said frame including a housing having a cover plate for supporting the hand that is doing the exercises, at least one pair of axially aligned sliders, which are exposed on one side and axially slidably mounted in said frame and have confronting faces, said housing including opposite side walls extending in the axial direction of said sliders, said side walls carrying thumb abutments that protrude above said cover plate adjacent to said slider, each of said confronting faces being formed with a depression which is open on said exposed side of the slider and adapted to receive a fingertip, and spring means urging said sliders of said pair toward each other.

10. An appliance as set forth in claim 9, wherein said thumb abutments are slidably mounted in said side walls and adjustable along the same, and screw means are provided for fixing said thumb abutments in said side walls in their adjusted positions.

* * * * *